US005662344A

United States Patent [19]

Lu

[11] Patent Number: 5,662,344

[45] Date of Patent: Sep. 2, 1997

[54] CIRCULAR WALKER WITH IMPROVED SEAT AND WHEEL ASSEMBLIES

[76] Inventor: Li-Wei Lu, No. 59-16, Chiu She Lane, Chiu She Li, Taichung, Taiwan

[21] Appl. No.: 593,430

[22] Filed: Jan. 29, 1996

[51] Int. Cl.[6] ..... B62B 9/28

[52] U.S. Cl. ..... 280/87.051; 297/5; 16/18 R; 16/35 R

[58] Field of Search ..... 280/87.051, 87.041, 280/87.021; 16/18 R; 297/136, 5; 24/265 BC, 200, 198, 588

[56] References Cited

U.S. PATENT DOCUMENTS

| | | | |
|---|---|---|---|
| 1,914,298 | 6/1933 | Sauerwald | 24/200 |
| 2,965,943 | 12/1960 | Silver | 24/170 |
| 4,025,083 | 5/1977 | Saint | 280/87.05 |
| 4,225,146 | 9/1980 | Takeuchi | 280/87.02 |
| 4,463,840 | 8/1984 | Seynhaeve | 190/18 |
| 4,579,473 | 4/1986 | Brugger | 403/163 |
| 4,822,030 | 4/1989 | Cone | 272/70.3 |
| 5,054,851 | 10/1991 | Chiu | 297/136 |
| 5,056,776 | 10/1991 | Cheng | 272/70.3 |
| 5,234,226 | 8/1993 | Liu | 280/642 |
| 5,447,319 | 9/1995 | Huang | 280/87.051 |

*Primary Examiner*—Brian L. Johnson
*Assistant Examiner*—Bridget Avery
*Attorney, Agent, or Firm*—Bacon & Thomas

[57] ABSTRACT

A circular walker having an improved seat assembly and wheel structure. The seat structure includes a lace sewn between the seat and a backrest cover, buckles extending with a cloth strip on the sides and rear of the lace on the seat and engaging sheets on a front. The engaging sheets and buckles are inserted through holes in the carriage and hook on the carriage to fix the seat to the carriage. The wheels prevent foreign objects from rolling into the axle center without need of riveting the axle center. Each wheel has a seat body, two wheel bodies, a seal cover and a main seal cover, the main seal cover having an integral axle hole engaged by a distal end of an axle rod having an engaging block. The seal cover and main seal cover and main seal cover assembled together by inserting the axle rod through axle holes.

5 Claims, 10 Drawing Sheets

CIRCULAR WALKER WITH IMPROVED SEAT AND WHEEL ASSEMBLIES

BACKGROUND OF THE INVENTION

The present invention relates to an improvement for a circular walker, and particularly to an improvement of the seat structure and improvement of the wheels, and such improvement is a novel structure to make easy and quick manufacture, assembly and disassembly. The structure of such wheels may prevent foreign goods from rolling into the axle center without need of rivetting the axle center so that it may attain such effects as easy and quick manufacture to reduce the production cost and minimize the risk of the wheel failure due to the influence of foreign goods.

The structure of conventional circular walker as shown in FIGS. 1A and 1B, and referring to FIG. 1A, it adopts buckle type assembly, and referring to FIG. 1B, it adopts screw type assembly. Referring to FIG. 1A, buckle type comprises a plurality of male buckles 21 distributed around the perimeter of assembly edge between the seat 11 and backrest 12, corresponding to the female buckles 22 on the binding 13, and for the assembly of the carriage, put the binding 13 on the carriage and press fit of male and female buckles 21, 22; referring to FIG. B, the seat is connected to the backrest 31, and a plurality of bolts 32 are set on the bottom edge of the backrest 31 and assembled on the top bowl 34 of the carriage, and a plurality of wing nuts 33 to screw up from the bottom of the top bowl 34.

The assembly of the two seats has the following defects:

1. Though buckle type is easy and quick for assembly, however, during the production the split sewing of male and females buckles must be properly align and this will cause additional trouble to the sewing workers so that sewing speed will become very slow.
2. Buckle type engaging strength is relatively weak to sustain less tension, and for a baby learning walking, it is very easy for it to suffer unexpected injury due to the separation of the seats owing to the buckles forcibly disengaged during the baby is playing by standing or sitting.
3. Screw type assembly: at first stick or screw up the backrest and the seat, then assemble the seat on the top bowl of carriage by means of bolts and wing nuts; not only the assembly procedure is complicated but also wing nuts have to be removed so as to dismount the seat (backrest) for cleanup and random placement of the wing nuts might be dismissed to cause trouble to the user.
4. Screw type assembly: the bolt portion could easily get rusty to cause dismounting problem in the future.

The wheels of the conventional circular walker relates to a simple wheel structure and too simple structure has resulted in durability problem. Referring to FIG. 2, the conventional structure comprises a seat body 1, two wheels 3 and axle rod 5 wherein the axle rod 5 penetrates through the seat body 1, the axle hole 2 of the wheel body 3 and rivetting on the other end (or screwing up by nut), i.e. two wheel bodies 3 have an open slot port 4 for manual rivetting (FIG. 3); it can known the said structure has following defects:

(1) The axle rod 5 (axle center) must be matched the tool for rivetting to increase equipment, assembly trouble and time waste and therefore assembly is not easy to cause higher production cost.

(2) The open slot port 4 on the axle hole 2 of the wheel body 3 is easy to roll in foreign goods such as hair A, thread and fiber, etc. because it is not sealed to cause choking up between the axle rod 5 and axle hole 2 to interfere rotation.

(3) The stress of rotation is sustained by the contact portion between the axle rod 5 and axle hole 2 to cause wearing of axle hole 2 wall to expand axle hole diameter so that rotation is not good due to inferior match with the axle rod 5.

These and other objects and advantages of the present invention will become apparent to those skilled in art after considering the following detailed specification together with the accompanying drawings.

DETAILED DESCRIPTION OF PREFERRED EMBODIMENT

Figure 1A:
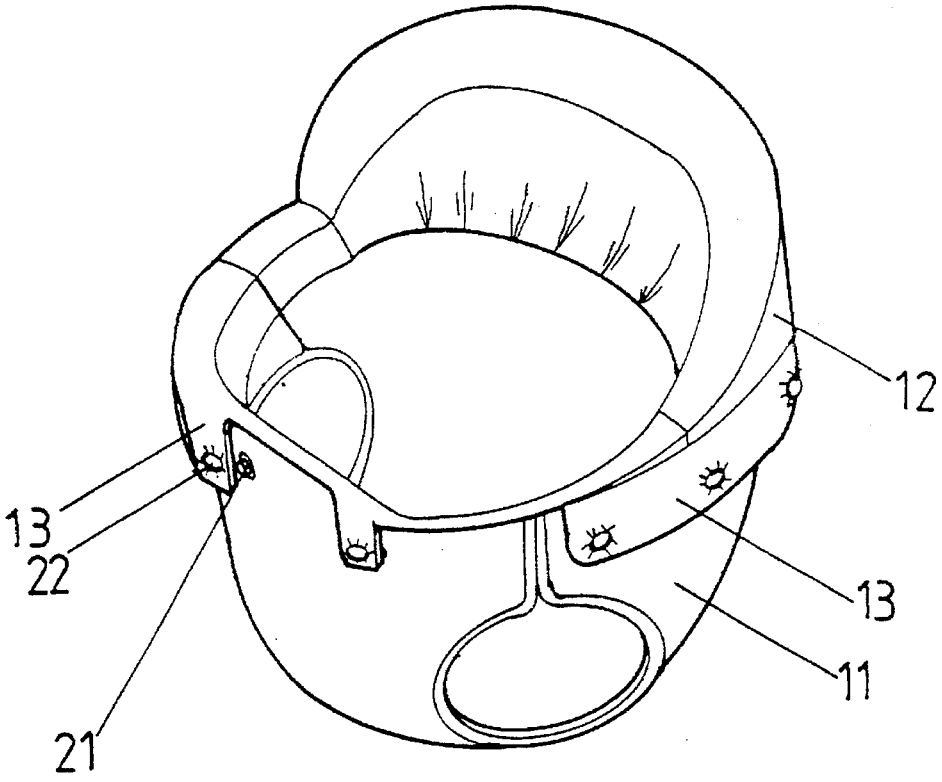
FIG.1(A)PRIOR ART
FIG. 1A is a structure of buckle type seat.
Figure 1B:
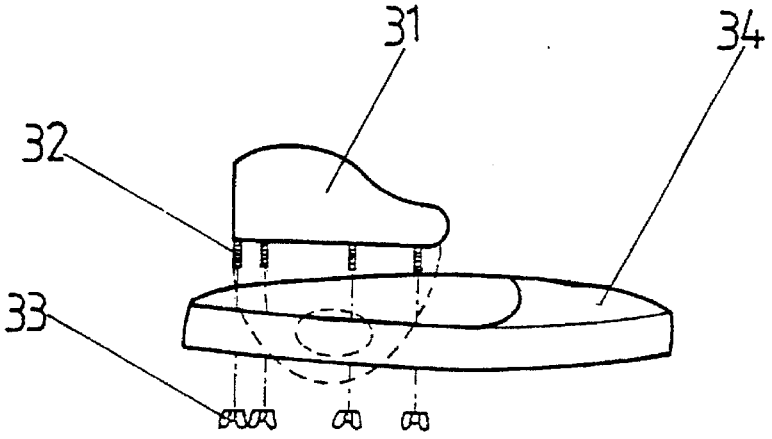
FIG.1(B)PRIOR ART
FIG. 1B is a schematic drawing of screw type seat.
Figure 2:
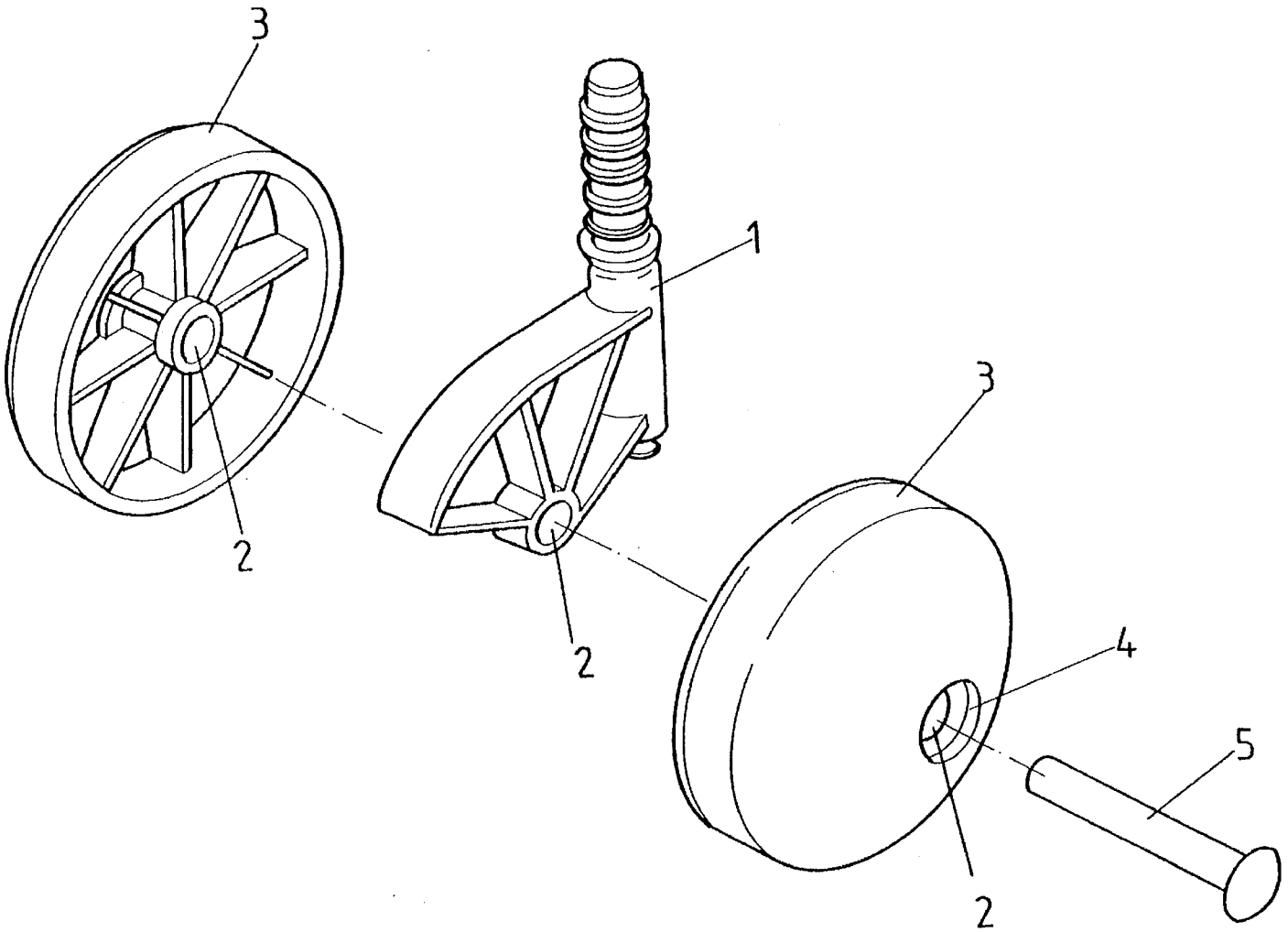
FIG.2 PRIOR ART
FIG. 2 is an elevational-exploded view of the conventional type.
Figure 3:
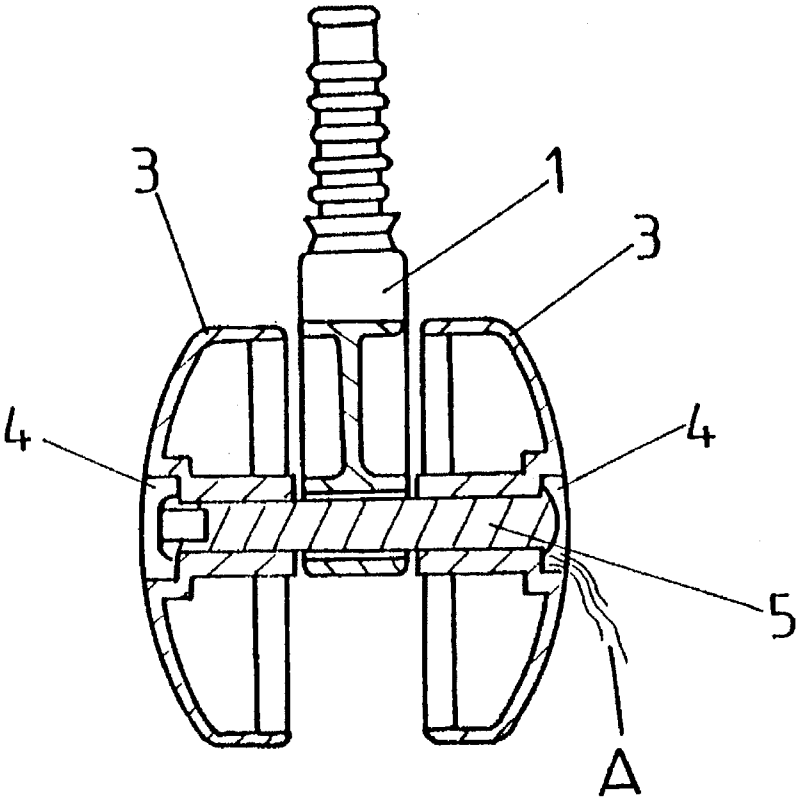
FIG.3 PRIOR ART
FIG. 3 is a perspective view showing the assembly of the conventional type.
Figures 4A, 4B, 4C:
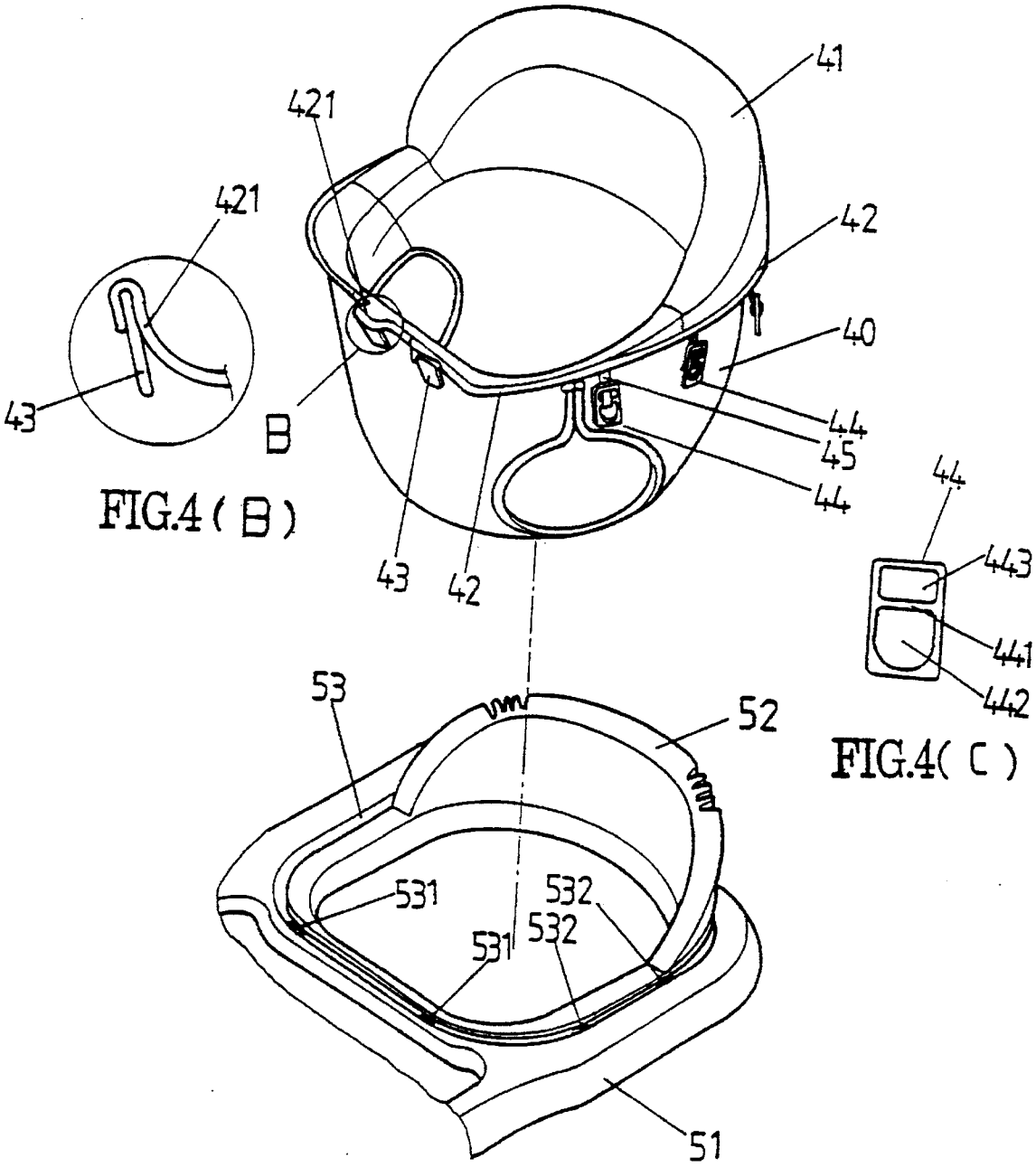
FIG. 4A is an exploded perspective view of the present invention.
FIG. 4B is an enlarged side view of area B in FIG. 4A.
FIG. 4C is an enlarged front view of the buckle of FIG. 4A.
Figures 5A, 5B, 5C:
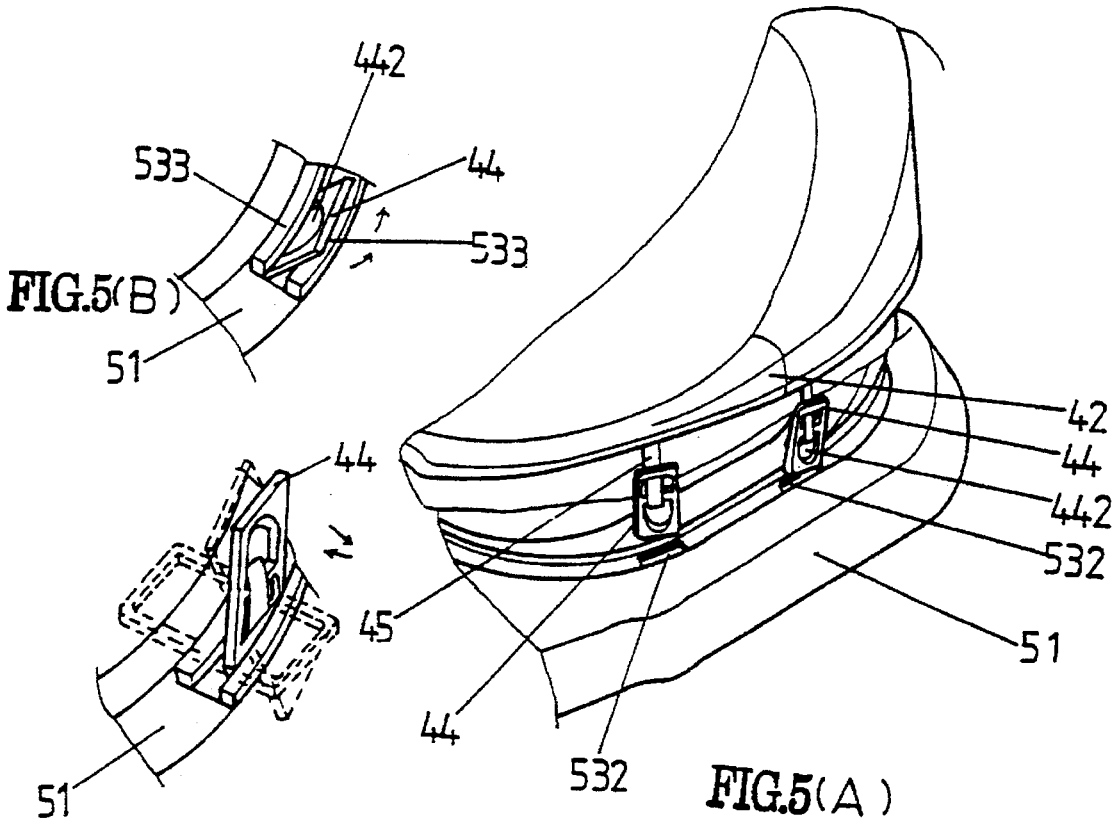
FIGS. 5A, 5B and 5C are schematic drawings showing the assembly of the present buckle type.

Referring to FIG. 4, the seat 40 is integrally sewing with the backrest cover 41 which is put on the backrest 52 of the carriage top bowl 51, and connection portion between the seat 40 and the backrest cover 41 has a lace 42; the lace 42 has an inwardly and downwardly bevel engaging sheet 43 sewing on the distal end of the flange 421 at a proper distance from the leading end of the seat 40; the engaging sheet 43 is made from plastic material, and located on the left, right and rear sides of the lace 42 on the seat 40, and winding buckle 44 is extending with cloth strip 45; the lateral bar 441 in the buckle 44 is located on one side to form major and minor slot holes 442, 443; the major slot hole 442 has an arc to provide for insertion of a finger; a slot 53 is located around the backrest 52 of carriage top bowl 51 corresponding to the lace 42, and the bottom of the slot 53 has square holes 531, 532 corresponding to the engaging sheet 43 and buckle 44 to provide for the engaging sheet 43 and buckle 44 to mount in the bottom of the slot 53 (FIGS. 4, 5B, 5C are the bottom view of the top bowl 51), and each side of square holes 531, 532 has flange wall 533.

Figure 8:
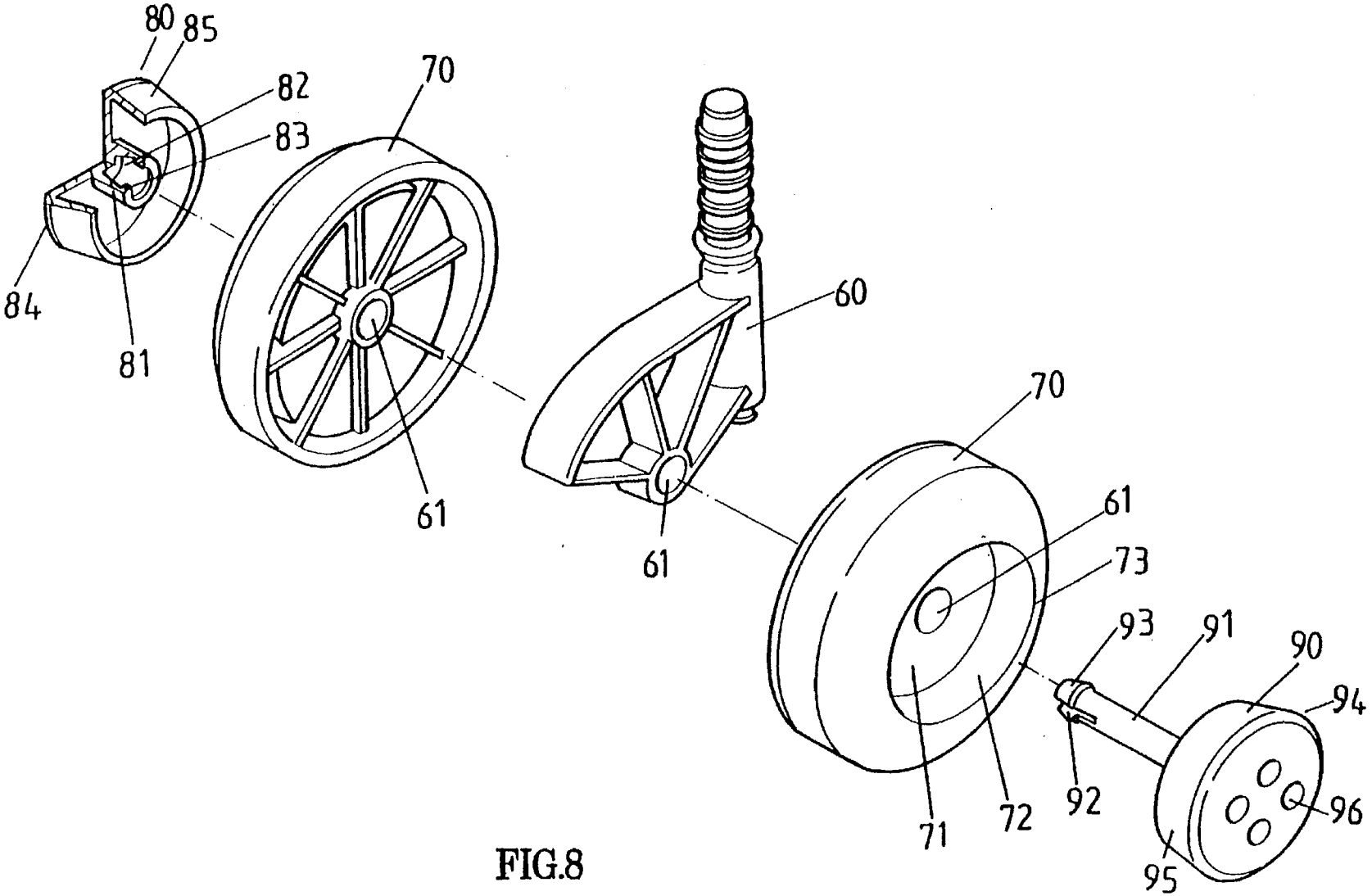
FIG. 8 is an elevational-exploded view of the present invention.

Referring to FIG. 8, the present invention comprises a seat body 60 having axle hole 61, two wheel bodies 70 and seal cover 80, main seal cover 90; it is characterized by:

the wheel body 70 having assembly slot 71 on the external side, and the slot wall having a cone 72 and perimeter angle having arc recess edge 73;

the seal cover 80 having hollow connection seat 81 to form an engaging slot 82, and slot wall having flange 83, and outer perimeter having a cone 85 corresponding to the assembly slot 71 of the wheel body 70, and outer round angle having arc flange 84;

the main seal cover 90, having integrally molded axle rod 91 on one side, and distal end of the axle rod 91 having expansion slot 92 and projective inset block 93 corresponding to the engaging slot 82, flange 83 of the seal cover 80 and connection seat 81; and the outer perimeter having cone 95 and outer round angle having arc flange 94 corresponding to the assembly slot 71 of the wheel body 70.

Figures 6A, 6B, 6C:
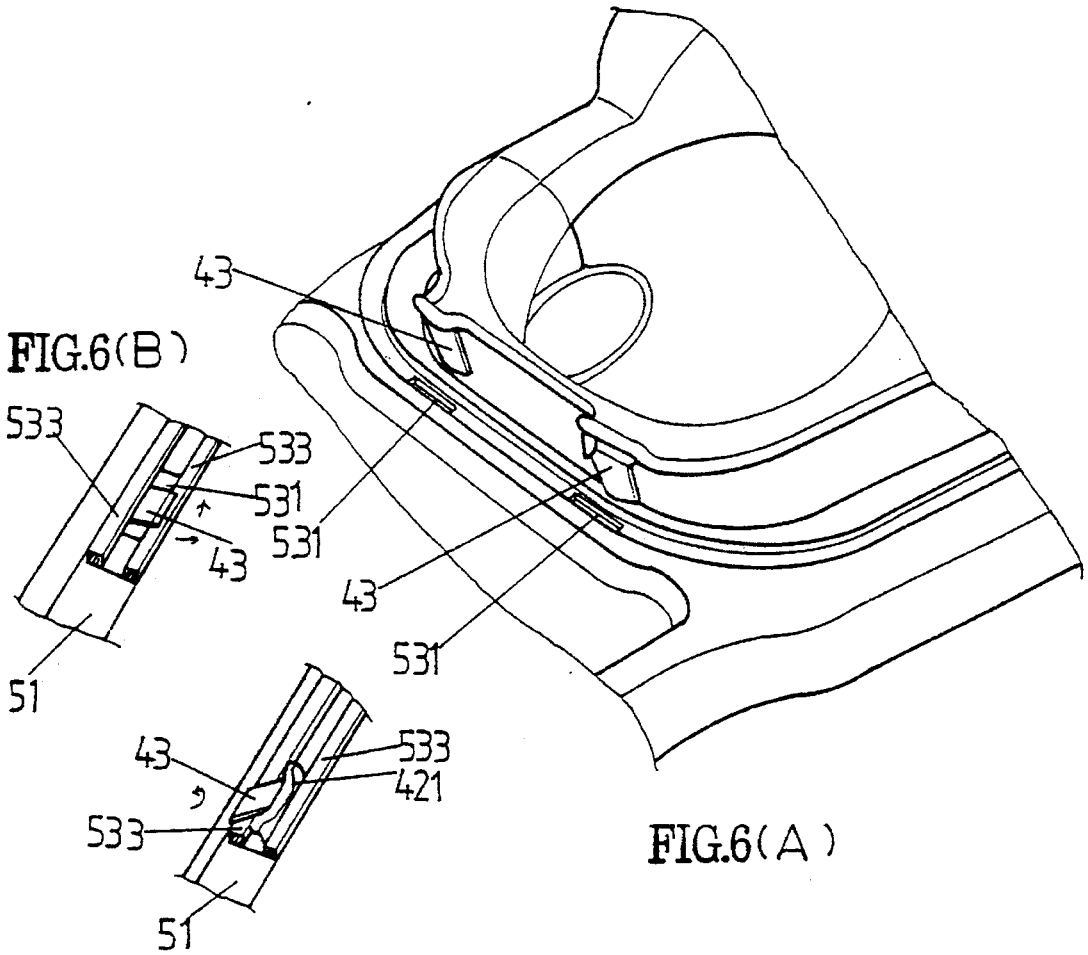
FIGS. 6A, 6B and 6C a schematic drawings showing the assembly of the present hook type.
Figure 7C:
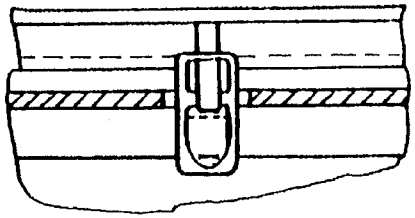
FIG. 7C is an enlarged view of area C in FIG. 7A.
Figure 7D:
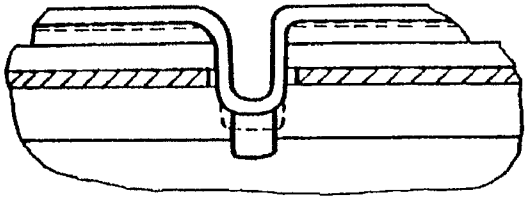
FIG. 7D is an enlarged view of area D in FIG. 7A.
Figure 7A:
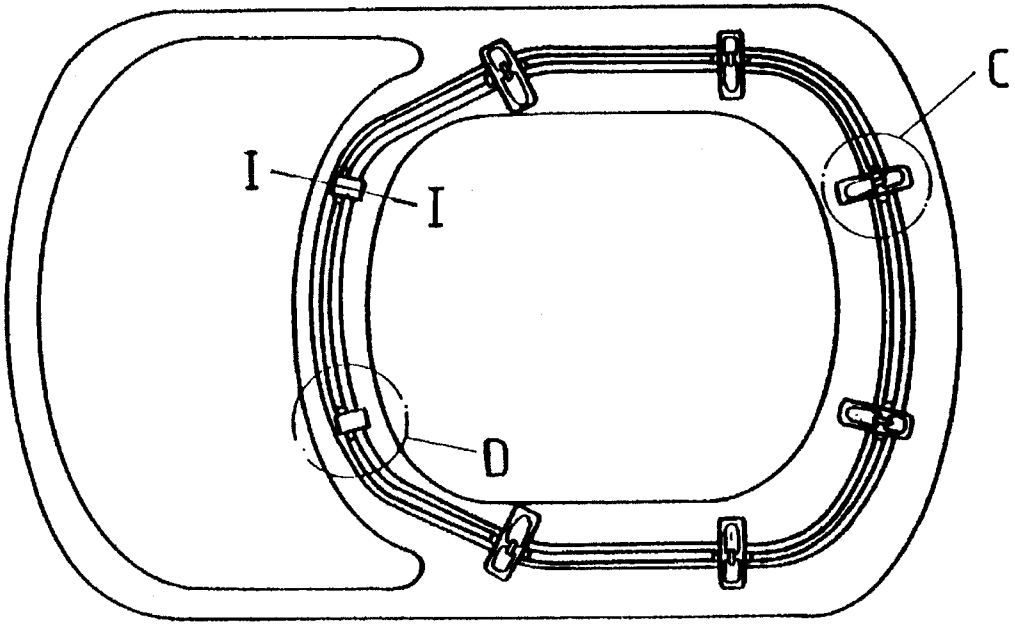
FIG. 7A is bottom view showing the assembly of buckle, hook and carriage top bowl.
Figure 7B:
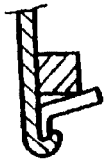
FIG. 7B is a cross-sectional view taken along line I—I of FIG. 7A.

The present seat assembly is described below:

1. Engaging or release of engaging sheet 43:

Referring to FIGS. 6A, 6B, 6C, the engaging sheet 43 is corresponding to the square hole 531 of the slot 53 on the leading end of the top bowl 51 and to be pressed therein; referring to FIGS. 6B, 6C, the engaging sheet 43 and lace flange 421 totally engaged in the square hole 531 to enable the engaging sheet 43 invertedly hooking up the flange wall 533 from disengaging (FIG. 7), and pull the lace 42 may cause the engaging sheet 43 holding tightly the flange wall 531 and therefore when the baby takes the seat 40, it will suffer the force to cause the lace 42 suffering force to pull the engaging sheet 43 whereby the engaging sheet 43 may impose stronger holding force upon the flange wall 531; if desire for disengaging the engaging sheet 43, and pull the lace flange 421 downward from the bottom of the top bowl 51 to cause the engaging sheet 43 disengaging from flange wall 533 to insert in the square hole 531 and to disengage from the lace 42 on the top; and therefore assembly or removal may not need use other tool for helping assembly or removal to cause easy operation.

2. buckle 44 engaging or release

Referring to FIGS. 5A, 5B and 5C, buckle 44 of the lace 42 has a major slot hole 442 facing downward for receiving a finger and corresponding to square hole 532 to set therein; referring to FIGS. 5B, 5C, the major slot hole 442 of buckle 44 is pressed in from the bottom of the square hole 532 so we may push our finger in the major slot hole 442 vertical to the square hole 532 to pull buckle 44 whereby buckle 44 and propagated cloth strip 45 may pass over the square hole 532 and locate buckle 44 horizontally to cause buckle 44 not to disengage, and the major slot hole 442 of each buckle 44 is located facing inward, and the minor hole 443 faces outward as shown in FIG. 5, and pull the lace 42 from the front side may cause buckle 44 holding flange wall 533 more tightly. If desire to disengage buckle 44 from the square hole 532 as shown in FIG. 5C, pull the major hole 442 of buckle 44 to cause distal end of the minor slot hole 443 corresponding to the square hole 532, and push buckle 44 to be perpendicular to the square hole 532, and buckle 44 may pulled to disengage from the other lace or propagated cloth strip 45; and as the same no tool is needed for the assembly or removal of buckle 44 so it is very easy for assembly.

The effectiveness of the seat structure is as below:

1. Simple structure, easy manufacture, engaging sheet and propagated cloth strip sewing on the lace, and give sewing mark on the lace in facility of sewing.
2. Integral design of slot and square hole on the top bowl of carriage, easy manufacture and accurate position of square hole.
3. Easy assembly and removal of components without need of using other tool for assembly/removal.
4. Stable assembly structure, inverted hooking up of the engaging sheet and buckle holding the square port horizontally, when the seat sustains force, its support strength may become better.

Figure 9B:
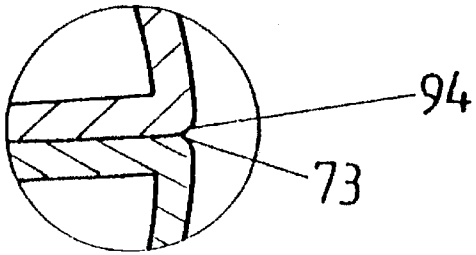
FIG. 9B is an enlarged view of area E in FIG. 9A.
Figure 9A:
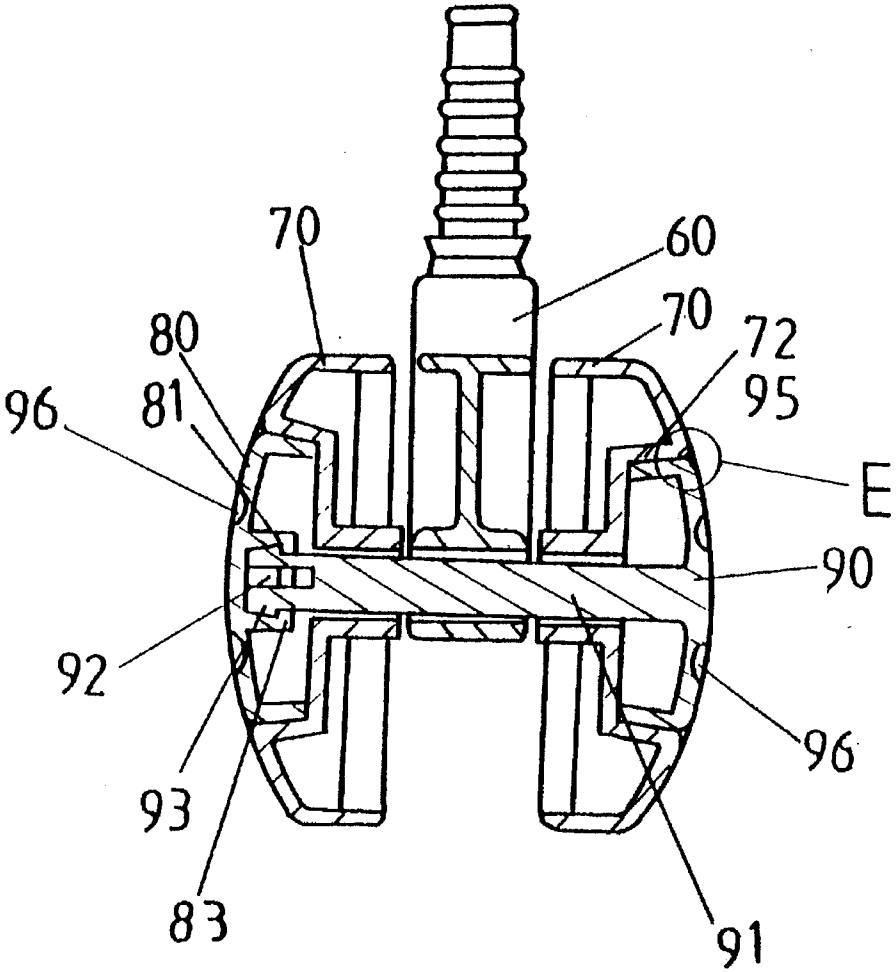
FIG. 9A is a cross-sectional view of the present wheel assembly.
Figure 10:
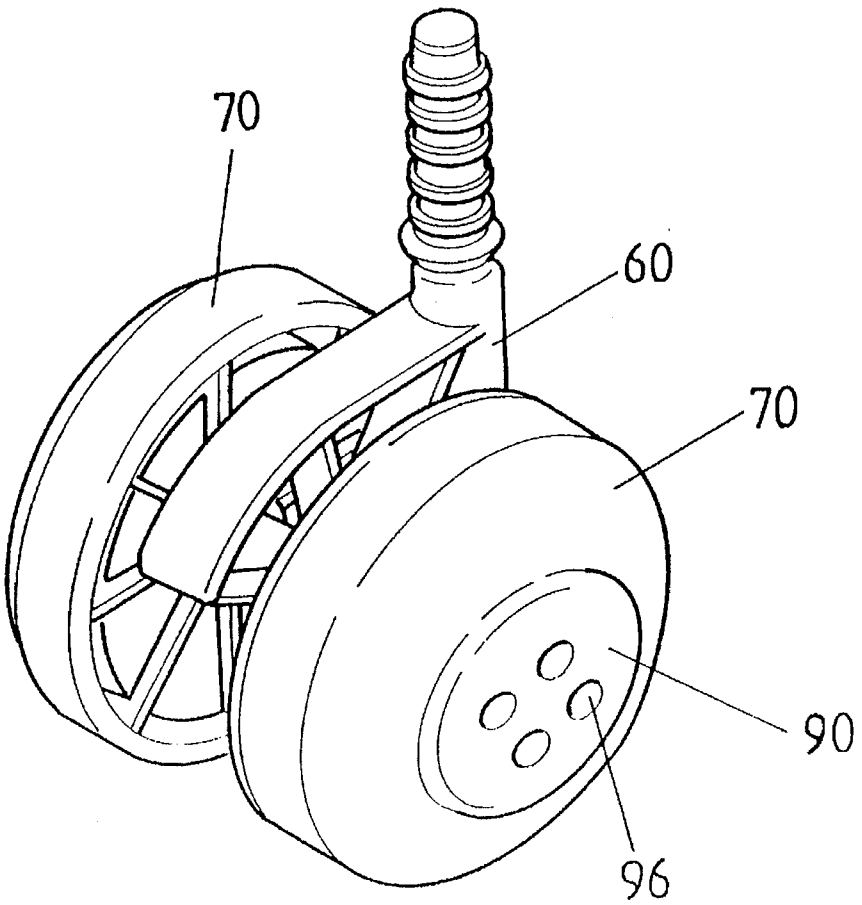
FIG. 10 is a perspective view of the present wheel assembly.

Referring to FIG. 9, the axle rod 91 of the main seal cover 90 may penetrate the wheel body 70, the axle hole 61 of the seat body 60 and to mount the auxiliary seal cover 80 from the other side; the engaging slot 82 on the connection seat 81 of the seal cover 80 is mounted in the engaging block 93 on the axle rod 91 of the main seal cover 90, because of expansion slot 92 slight reducing diameter may facilitate it to mount in and its original diameter can be restored after assembly to allow the engaging block 93 properly to engage with the flange 83 whereby the seal cover 80 and main seal cover 90 are connected integrally and further the two wheel bodies 70 and seat body 60 can be assembled together (FIG. 10) without need of any tool.

The present invention may be fully automated assembly (in association with automatic machine), and the side of the seal cover 80, main seal cover 90 has recess 96 (FIG. 9) to allow for insertion as the support point for removing the seal cover and main seal cover in facility of operation.

According to the above statement, the present invention has following advantages:

(1) Because no need of machine, it is easy and quick for assembly (manufacture) to reduce production cost.

(2) The axle rod 91 and axle hole 61 have seal cover 80, main seal cover 90 for sealing to prevent the intrusion of foreign goods such as hair by winding to lower the risk of rotation error.

(3) The arc recess 73 and arc flange 94 on the wheel body 20 and seal cover 80 (main seal cover 90) may strengthen sealing effect (nonlinear plane) to prevent the intrusion of foreign goods such as hair by winding.

(4) The stress of rotation is sustained by the axle rod 90, axle hole 61, and seal cover (main seal cover) and assembly slot may also share the stress by a large circumference diameter to reduce wearing rate of the axle hole 61.

I claim:

1. A circular walker having an improved seat assembly and wheel structure comprising: a seat assembly including a lace between a seat and a backrest cover, said lace having a plurality of inwardly and downwardly extending engaging sheets located on left, right and rear sides of the lace, and a plurality of buckles attached to the lace by cloth strips, each buckle having a lateral bar located so as to form major and minor slot holes through the buckle the major slot hole having a curved side to provide for insertion of a finger; a carriage having a backrest and a slot located around the backrest, the bottom of the slot having square holes engaging the engaging sheets and buckles, each square hole having side flange walls to hold the buckles to attach the seat assembly to the carriage.

2. The circular walker as claimed in claim 1, wherein when the buckles engage the square holes and the flange walls, the major slot hole of each buckle faces outwardly and the minor slot hole faces inwardly.

3. The circular walker as claimed in claim 1, further comprising a wheel structure including a seat body having an axle hole, two wheel bodies, a seal cover and a main seal cover, each wheel body having an assembly slot on an external side, a slot wall and perimeter angle having an arc recess edge;

the seal cover having a hollow connection seat with an engaging slot, a slot wall having a flange, and an outer perimeter having a configuration corresponding to that of the assembly slot of the wheel body, and an outer round arc flange;

the main seal cover having an integrally molded axle rod extending from one side, a distal end of the axle rod having an expansion slot and a projecting insert block engaging the engaging slot; the flange of the seal cover and the connection seat includes an outer perimeter having an outer round are flange corresponding to the assembly slot of the wheel body;

whereby the engaging block on the axle rod fixedly engages the flange on the engaging slot of the connection seat after passing through the axle hole of the seat body to assemble the wheel, the seal cover and the main seal cover sealing the assembly slots to prevent foreign objects from winding onto the axle rod.

4. The circular walker as claimed in claim 3, wherein the are recess and are flange on the wheel body, and seal cover and main seal cover are assembled together to form a nonlinear plane to prevent the intrusion of foreign objects.

5. The circular walker as claimed in claim 3, wherein the seal cover and main seal cover have recesses on external sides.

* * * * *